United States Patent [19]

Seki

[11] Patent Number: 4,459,834

[45] Date of Patent: Jul. 17, 1984

[54] REMOTE CONTROL DOOR-LOCK DEVICE FOR AN AUTOMOTIVE VEHICLE

[75] Inventor: Shojiro Seki, Yokohama, Japan

[73] Assignee: Nissan Motor Company, Limited, Yokohama, Japan

[21] Appl. No.: 341,791

[22] Filed: Jan. 22, 1982

[30] Foreign Application Priority Data

Feb. 5, 1981 [JP] Japan ..... 56-14346[U]

[51] Int. Cl.[3] ..... E05B 65/12

[52] U.S. Cl. ..... 70/256; 70/264; 292/336.3; 292/DIG. 3; 292/DIG. 25

[58] Field of Search ..... 70/256, 257, 181, 262, 70/263, 264; 292/336.3, DIG. 23, DIG. 25, DIG. 3, DIG. 62

[56] References Cited

U.S. PATENT DOCUMENTS

| | | | |
|---|---|---|---|
| 1,662,985 | 3/1928 | Signore . | |
| 2,202,834 | 6/1940 | Clarkson-Jones | 292/DIG. 3 |
| 2,265,572 | 12/1941 | Olinger | 292/DIG. 3 |
| 2,314,815 | 3/1943 | Brandt | 180/82 |
| 2,316,199 | 4/1943 | Vetter | 70/264 |
| 2,572,129 | 10/1951 | Fuller | 292/DIG. 3 |
| 2,973,984 | 3/1961 | Burke | 292/182 |

FOREIGN PATENT DOCUMENTS

| | | |
|---|---|---|
| 1964113 | 4/1967 | Fed. Rep. of Germany . |
| 2721970 | 11/1978 | Fed. Rep. of Germany . |
| 7834641 | 4/1979 | Fed. Rep. of Germany . |
| 2808278 | 9/1979 | Fed. Rep. of Germany . |
| 2811990 | 9/1979 | Fed. Rep. of Germany . |
| 1210972 | 10/1959 | France . |

*Primary Examiner*—Robert L. Wolfe

*Attorney, Agent, or Firm*—Lane, Aitken & Kananen

[57] ABSTRACT

A remote control door-lock device connected to front and rear door lock devices for an automotive vehicle used to lock/unlock the front and rear vehicle doors from a position near a driver seat comprises one or two guide plates having a slot formed therein and one or two actuation members having projection pins on one side thereof and an opening on the other side thereof. The guide plates are controlled by a remote control lever via a cable, and the slots thereof engage the pins so that the guide plates control the position of the actuation members, but with some mutual free travel. The actuation members also engage with front and rear door lock members, usable by passengers, so that if the remote control lever is actuated, the door lock members are in turn actuated to lock the respective doors, and to disable the door lock members. That is, the door lock members can be actuated either directly or by the remote control lever.

6 Claims, 8 Drawing Figures

(A)

KNOB: UNLOCK
LEVER: NEUTRAL
ACTUATION M: NEUTRAL (B)

KNOB: LOCK
LEVER: LOCK
ACTUATION M: LOCK (C)

KNOB: LOCK
LEVER: NEUTRAL
ACTUATION M: LOCK (D)

KNOB: UNLOCK
LEVER: UNLOCK
ACTUATION M: UNLOCK

REMOTE CONTROL DOOR-LOCK DEVICE FOR AN AUTOMOTIVE VEHICLE

BACKGROUND OF THE INVENTION

1. Field of the Invention

The present invention relates to a remote control door-lock device for an automotive vehicle, and more specifically to a remote control door-lock device connected to the front and rear door lock devices and disposed within a pillar, used to lock/unlock front and rear doors from a position near the driven seat.

2. Description of the Prior Art

In a sample prior-art remote control door-lock device for an automotive vehicle, a cable connecting a remote control lever to a door-lock mechanism usually passes through a front pillar in the case of the front door and through a center pillar or a lock pillar in the case of the rear door, independently. Therefore, the cable inevitably is long and must branch at a position midway thereof, thus resulting in great frictional losses, and complicated assembly.

A more detailed description of the prior art remote control door-lock device will be made under DETAILED DESCRIPTION OF THE PREFERRED EMBODIMENTS with reference to the attached drawings.

SUMMARY OF THE INVENTION

With these problems in mind therefore, it is the primary object of the present invention to provide a remote control door-lock device for an automotive vehicle using a short cable passing through the center pillar or the lock pillar in order to reduce frictional losses caused by the cable and to improve reliability of a door locking/unlocking operation.

To achieve the above-mentioned object, the remote control door-lock device for an automotive vehicle according to the present invention comprises a cable passing through a center pillar or a lock pillar, one or two guide plates connected to a remote control lever via the cable and having a slot formed therein, and one or two actuation members pivotably supported on the pillar and having a projection and an opening formed therein, in addition to a pair of front and rear door lock members engageable with the opening of the actuation member.

The projection of the actuation member is engaged, beyond a predetermined free travel, with the slot formed in the guide plate connected to the remote control lever, and the opening portion of the actuation member is engaged with an engagement lever portion of the front or rear door lock member, each having a lock knob at the top thereof.

In the remote control door-lock device thus constructed, therefore, the remote control lever and the front and rear door lock knobs can independently actuate the actuation member, that is, separately lock/unlock the vehicle doors.

BRIEF DESCRIPTION OF THE DRAWINGS

The features and advantages of the remote control door-lock device for an automotive vehicle according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

To facilitate understanding of the present invention, a brief reference will be made to a prior-art remote control door-lock device for an automotive vehicle.

Figure 1:
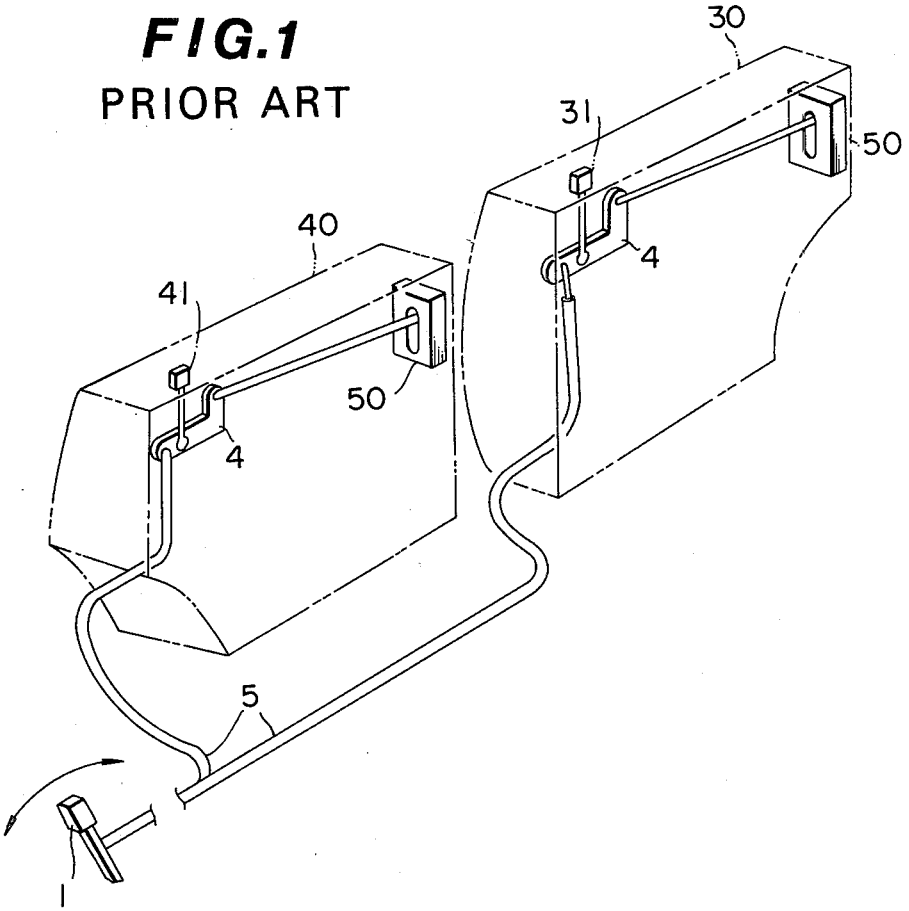
FIG.1 PRIOR ART
FIG. 1 is a perspective diagrammatical view of assistance in explaining the structure of the prior-art remote control door-lock device.

As shown in FIG. 1, a prior-art remote control door-lock device of this kind comprises a remote control lever 1 disposed at a position near the driver's seat, and a cable 5 one end of which is connected to the remote control lever 1 and the other end of which is connected to bell-cranks 4 of the lock knobs 31 and 41 for a rear door 30 and a front door 40. When the above-mentioned remote control lever 1 is moved and therefore the cable 5 is pulled or pushed, the end of the cable 5 is moved back and forth to swing the bell-crank 4, so that the front and rear door lock devices 50 are actuated or released.

In the prior-art remote control device, however, since the above-mentioned cable 5 passes through a front pillar in the case of the front door 40 and a center pillar or a lock pillar in the case of the rear door 30 and through the hinged side of each door 30 or 40, and the end thereof is connected to the bell-cranks 4 connected to the lock knobs 31 and 41 and to the door-lock devices 50, the cable 5 must be relatively long and must branch to both doors at some point along its path in the case where this remote control device is used for a four-door automotive vehicle. Therefore, the route through which the cable 5 passes is indirect, resulting in great frictional losses and a more complicated assembly due to much restriction on the layout of the cable.

In view of the above description, reference is now made to a first embodiment of the remote control door-lock device according to the present invention.

Figure 2:
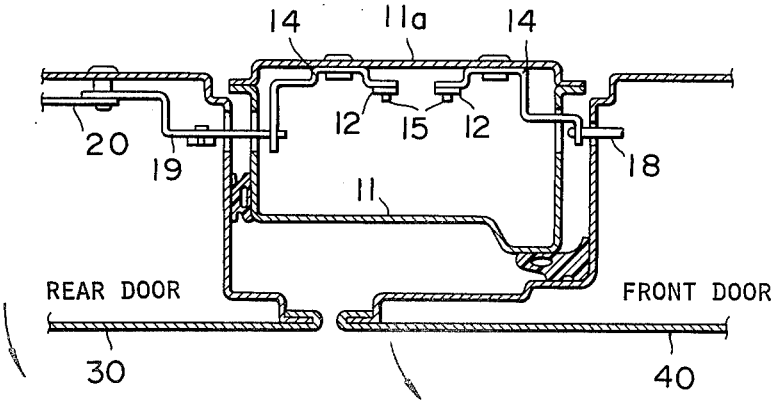
FIG. 2 is a cross-sectional top view of a vehicle body pillar and passenger doors in which the remote control door-lock device of a first embodiment according to the present invention is assembled.
Figure 3:
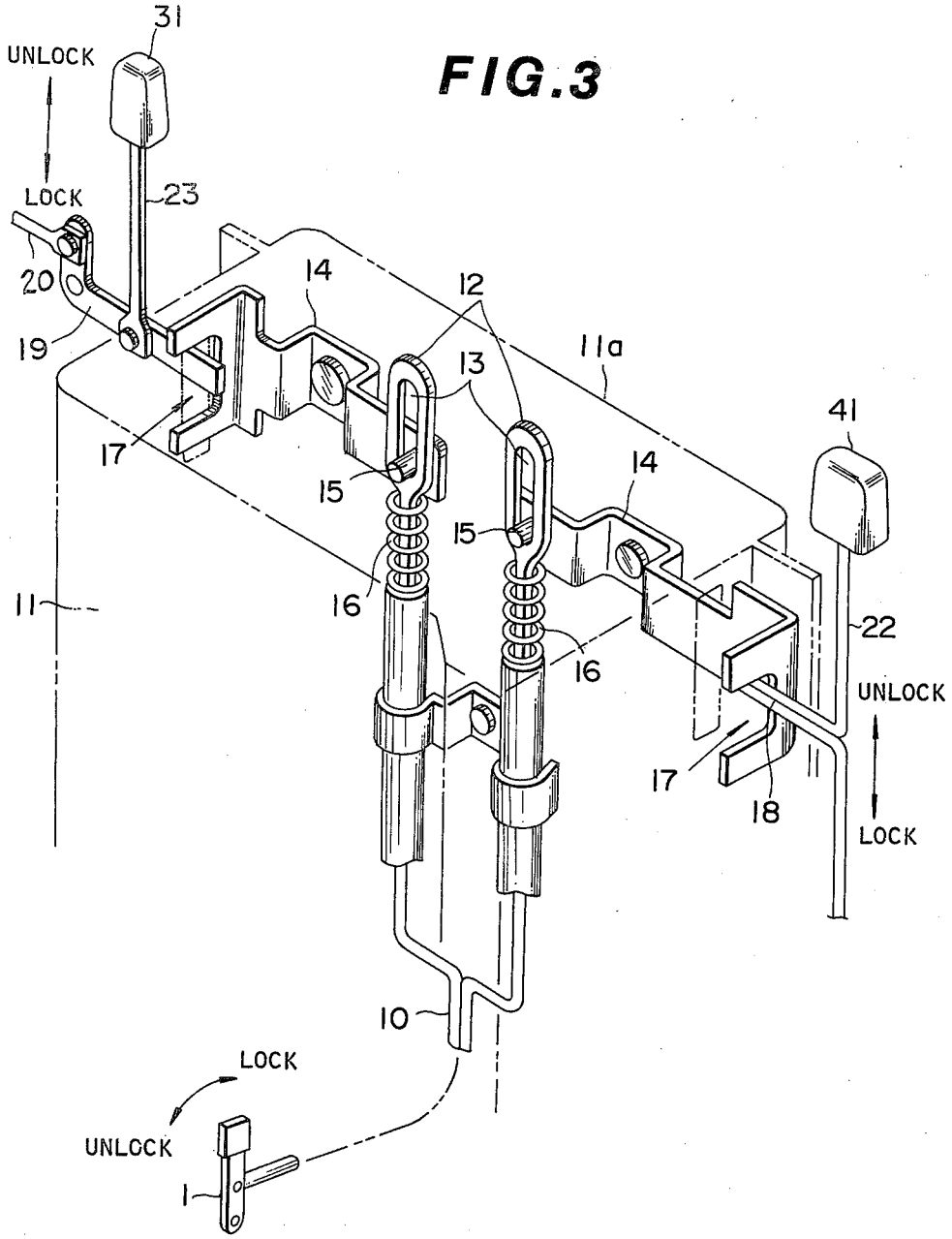
FIG. 3 is a perspective view showing the structure of the remote control door-lock device shown in FIG. 2.

FIGS. 2 and 3 show a first embodiment according to the present invention. In FIG. 2, the front door 40 is hinged to a front pillar (not shown) and is opened outwardly in the direction shown by the arrow (right side); the rear door 30 is hinged to a center pillar 11 by a hinge (not shown) and is opened outwardly in the same direction as in the front door 40. In FIG. 3, the reference numeral 1 denotes a remote control lever disposed at a position near the driver's seat, which is automatically returned to its neutral position by the force of a spring (not shown) or manually reset to its neutral position by the aid of a detent mechanism. Further, in this case, the unlock travel of the lever 1 is greater than the lock travel of the lever 1, as explained in more detail in FIG. 4 later. The reference numeral 10 denotes a cable one end of which is connected to the remote control lever 1 and the other end of which passes through a center pillar or a lock pillar 11. This cable 10 is of the type capable of transmitting force both in tension and in compression, such as a bowden cable. The reference numeral 12 denotes a guide plate with a slot 13 formed at the top portion thereof, which is biased by a return spring 16 toward a neutral position between the locked position and the unlocked position. The return spring 16 is disposed below the slot 13 of the guide plate 12 concentrically therewith. The reference numeral 14 denotes an actuation member with a projection such as a pin 15 at one end thereof and a U-shaped opening 17 at the other end thereof, and which is pivotably supported on the inner panel 11*a* of the pillar 11. The reference numeral 22 denotes a front door lock member with a lock knob 41 on its top end and an engagement lever 18 below the knob 41 at a level opposite the U-shaped opening 17 of one actuation member 14. This door lock member 22 is connected to a front door lock device (not shown) to lock the front door when lowered and to unlock the front door when raised via the mechanism denoted by the reference numeral 4 in FIG. 1. The reference numeral 23 denotes a rear door lock member connected to a bell-crank 19. This bell-crank 19 is connected to a rear door lock device (not shown) via a rod 20 to lock the rear door when rotated clockwise and to unlock the rear door when rotated counterclockwise.

Figure 4:
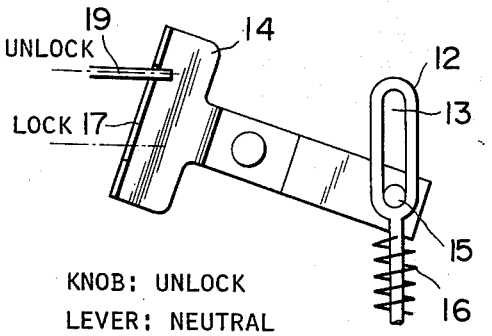
FIGS. 4(A), (B), (C) and (D) are views for assistance in explaining the operation of the first embodiment.
Figure 4:
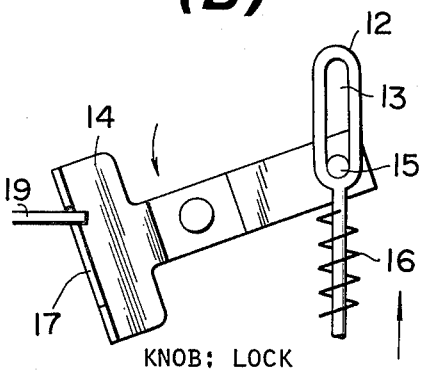
Figure 4:
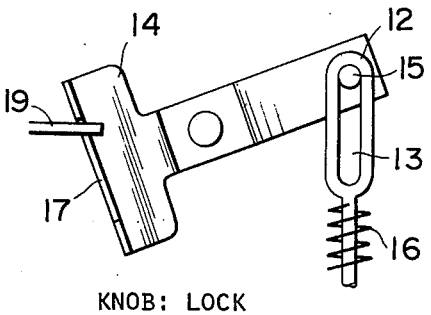
Figure 4:
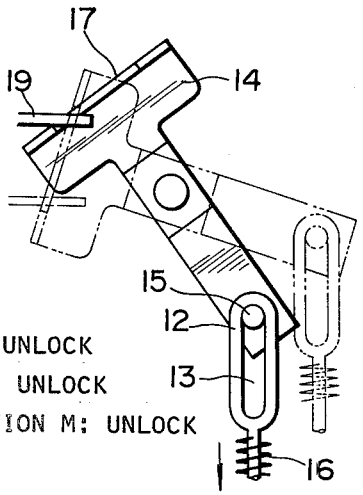

The projection pin 15 fixed to the actuation member 14 fits movably within the slot 13 formed in the guide plate 12. As shown in FIG. 4, the guide plate 12 can move the pin 15 of the actuation member 14 upward, that is, toward the locked position only when the pin 15 is in its lower position, that is, in the unlocked position. In other words, the guide plate 12 cannot move the pin 15 upwards when the actuation member 14 is already in the locked position.

On the other hand, the guide plate 12 can move the pin 15 of the actuation member 14 downward, that is, toward the unlocked position only when the pin 15 is in its upper position, that is, at the locked position. In other words, the guide plate 12 cannot move the pin 15 downwards when the actuation member 14 is in the unlocked position. That is to say, the guide plate is engaged with the actuation member with some mutual free travel according to their locked/unlocked states.

The engagement lever 18 of the front door lock member 22 and the end of the bell-crank 19 to which the rear door lock member 23 is connected also movably fit within the openings 17 of the actuation members 14. The openings 17 are wider than the members engaged therewith, the door lock members 22 and 23 can move the openings 17 of the actuation members 14 downwards, that is, toward the locked position only when the openings 17 are positioned in their upper positions, that is, in the unlocked position. In other words, the door lock members 22 and 23 cannot move the openings 17 downwards when the actuation members 14 are already in the locked positions.

On the other hand, the door lock members 22 and 23 can move the openings 17 of the actuation members 14 upwards, that is, toward the unlocked positions only when the openings 17 are in their lower positions, that is, in the locked positions. In other words, the door lock members 22 and 23 cannot move the openings 17 upwards when the actuation members 14 are in the unlocked position. That is to say, the door lock members are engaged with the actuation member with some mutual free travel according to their respective locked/unlocked states.

Further, in this embodiment, the lower ends of the guide plates 12 are attached to one another and to the cable 10 so as to move integrally in response to the cable 10.

Further, since the U-shaped opening 17 are formed in the actuation members 14 opening outward with respect to the vehicle, when the front door 40 or the rear door 30 is opened in the direction of the arrows shown in FIG. 2, the engagement lever portion 18 (engagement member) of the front door lock member 22 or the end of the bell-crank 19 of the rear door lock member 23 can disengage from the corresponding opening 17 of the actuation member 14 without any interference therewith.

Now follows a description of the mutual movements and the operations of the lock knob 31 attached to the door lock member 22 or 23 (the bell-crank 19 or the lever portion 18), the actuation member 14, and the guide plate 12 with reference to FIGS. 4(A)–4(D), in which only one actuation member 14 and one guide plate 12 are shown.

FIG. 4(A) shows the state where the lock knob 31 is set to the unlocked position, the remote control lever 1 is set to the neutral position, and the actuation member 14 is also set to the neutral position. In this state, it is possible to lock the door by moving downward the lock knob 31 connected to the door lock member 23 without moving the remote control lever 1 and the actuation member 14, because the bell-crank 19 is positioned at the upper end of the opening 17. In this state, even if the door is opened and next closed after the lock knob 31 has been set to the locked position (downward), since the bell-crank 19 can freely come into the lower end of the opening 17, the closed door is locked without damaging the actuation member 14.

FIG. 4(B) shows the state where the lock knob 31 is set to the locked position, the remote control lever 1 is set to the locked position and the actuation member 14 is also set to the locked position, which is obtained when the remote control lever 1 is moved in the locked direction from the state shown in FIG. 4(A) to lock the door. Since the bottom end of the slot 13 moves the pin 15 upward, the opening 17 goes downward to lower the bell-crank 19, so that the lock knob is set to the locked position by the remote control lever 1.

FIG. 4(C) shows the state where the remote control lever 1 is released to the neutral position from the state shown in FIG. 4(B) with the actuation member 14 kept in the locked position. In this state, it is possible to unlock the door by pulling upward the lock knob 31 connected to the door lock member 23 without moving the remote control lever 1 because the projection pin 15 is engaged with the top end of the slot 13. When the lock knob 31 is pulled upward, the actuation member 14 rotates clockwise, so that the opening 19 goes upward with the bell-crank 19 to the state shown in FIG. 4(A).

FIG. 4(D) shows two states: one state (dot-dot-dash lines) where the lock knob 31 is set to the locked position, the remote control lever 1 is set to the half unlocked position and the actuation member 14 is also set to the neutral position and the other state (solid lines) where the lock knob 31 is set to the unlocked position, the remote control lever 1 is set the full unlocked position and the actuation member 14 is set to the unlocked position.

When the remote control lever 1 is moved in the unlocked direction to unlock the door from the state shown in FIG. 4(C), the slot 13 moves the pin 15 downward to the state shown by the dot-dot-dash lines. In this state, however, the lower end of the opening 17 of the actuation member 14 is only brought into contact with the bell-crank 19. When the remote control lever 1 is further moved in the unlocked direction to the position shown by the solid lines in FIG. 4(D), the lower end of the opening 17 moves the bell-crank 19, that is, the lock knob 13 to the unlocked position.

In this state, if the remote control lever 1 is released, since the remote control lever 1 returns to the neutral position by the force of the spring for the lever 1, the lower end of the slot 13 is first brought into contact with the pin 15 and next pushes the pin 15 upward, so that both the remote control lever and the actuation member 14 returns to the neutral position with the bell-crank 19 kept in the unlocked position. This state is the same as that shown in FIG. 4(A). Further, in this case, the unlock travel of the remote control lever 1 is roughly twice greater than the lock travel thereof.

Figure 5:
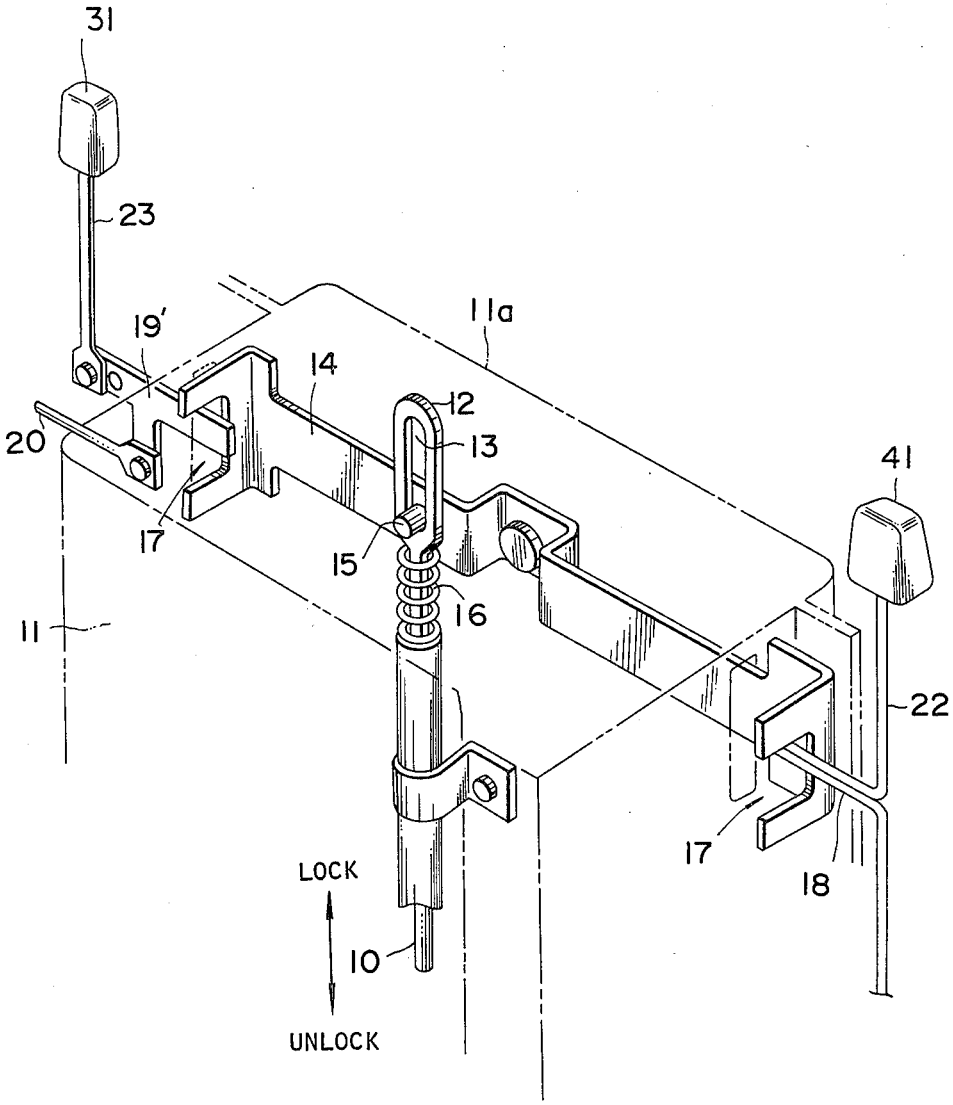
FIG. 5 is a perspective view showing the structure of a second embodiment of the remote control door-lock device according to the present invention.

FIG. 5 shows a second embodiment of the remote door-lock device according to the present invention.

This embodiment is different from the first embodiment in that it includes only one actuation member 14 and only one guide plate 12. The actuation member 14 has a single pivot point between the two door-lock members 22 and 23, and a single pin 15 on the rear-door side of the pivot. The guide plate 12 engages with the pin 15 as in the previous embodiment so that the front-door lock member 22 operates similarly to the first embodiment. However, the motion of the rear-door opening 17 is opposite that of the first embodiment. In order to adjust the locking direction on the rear-door side, a different bell-crank 19' is used. In more detail, since the rearward portion of the actuation member 14 is moved upward when the guide plate 12 is set to the lock position, the bell-crank 19' is so designed that the rod 20 is pulled when the bell-crank 19' is rotated counterclockwise. In other words, the connection point between the door-lock member 23 and the bell-crank 19' and the connection point between the rod 20 and the bell-crank 19' are positioned on the sides of the fulcrum opposite those of the first embodiment, respectively.

Further, in this embodiment, it is possible to reduce the number of necessary parts.

As described above, since cable connected to the remote control lever used to lock/unlock the vehicle doors passes only through the center pillar or the lock pillar, it is possible to reduce the length of the cable and to simplify the route markedly compared with the prior-art remote control door-lock device. As a result, frictional losses are reduced and assembly is simplified.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A remote control door-lock device connected to front and rear door lock devices for an automotive vehicle disposed within a pillar in order to lock/unlock front and rear vehicle doors from a position near a driver's seat, which comprises:

(a) a remote control lever supported near the driver's seat so as to be movable between locked, unlocked, and neutral positions;

(b) a cable connected to said remote control lever for transmitting the position of said remote control lever;

(c) at least one guide plate movably supported by the pillar and connected to said cable, so as to move with the remote control lever;

(d) front and rear door lock members connected to the front and rear door lock devices respectively and supported by the corresponding vehicle doors to be movable between locked and unlocked positions;

(e) at least one actuation member pivotably supported by the pillar and engaged with said guide plate and with said door lock member with some mutual free travel, said actuation member being movable by said guide plate from the neutral position to the lock position to lock the doors when said front and rear door lock members are in the unlocked position and movable by said guide plate from the lock position, through the neutral position, to the unlock position to unlock the doors when said front and rear door lock members are in the lock position.

2. The remote control door-lock device of claim 1, wherein said front- and rear-door lock members have engagement members, said guide plate has a slot of length corresponding to the travel of said remote control lever, and said actuation member has at least one opening for receiving said engagement member, said opening being wider than said engagement members and facing in the direction of opening of the vehicle doors, and at least one projection receivable within said slot, movable therewith, and positioned with respect to said guide plate such that when said guide plate is in the neutral position and said actuation member moves between the locked and unlocked positions thereof, said projection moves through said slot without contacting either end thereof.

3. The remote control door-lock device of claim 1, wherein said guide plate includes a spring for urging said guide plate toward the neutral position.

4. The remote control door-lock device of claim 2, wherein said front- and rear-door lock members further comprise a bell-crank pivotably supported by the corresponding vehicle door at a fulcrum, a lock knob attached to the bell-crank and accessible to a vehicle user for directly moving the bell-crank between locked and unlocked positions, and a connecting rod pivotably attached at one end to the bell-crank opposite the fulcrum from the lock knob and attached at the other end to the corresponding locking device.

5. The remote control door-lock device of claim 2, further comprising two actuation members pivotably supported at their centers and engaging said engagement members at one end thereof, and two guide plates attached so as to move integrally and each engaging with the projection at the end opposite said engagement member of one of said actuation members.

6. The remote control door-lock device of claim 2, further comprising exactly one actuation member pivotably supported at its center and engaging said engagement members at opposite ends thereof, and exactly one guide plate engaging with said projection at a position between the center of said actuation member and one end thereof.

* * * * *